US010741152B2

(12) United States Patent
Shahinian et al.

(10) Patent No.: US 10,741,152 B2
(45) Date of Patent: Aug. 11, 2020

(54) WEARABLE DRUMSTICK HOLDER PROVIDING TEAR-AWAY RETRIEVAL AND INTEGRATED PRACTICE PAD

(71) Applicant: Shahinian Drum Accessories, LLC, North Hollywood, CA (US)

(72) Inventors: Michael A. Shahinian, Granada Hills, CA (US); Ronald Girgis, North Hollywood, CA (US)

(73) Assignee: SHAHINIAN DRUM ACCESSORIES, LLC, North Hollywood, CA (US)

( * ) Notice: Subject to any disclaimer, the term of this patent is extended or adjusted under 35 U.S.C. 154(b) by 0 days.

(21) Appl. No.: 16/598,140

(22) Filed: Oct. 10, 2019

(65) Prior Publication Data

US 2020/0118529 A1 Apr. 16, 2020

Related U.S. Application Data

(60) Provisional application No. 62/766,340, filed on Oct. 15, 2018.

(51) Int. Cl.
*G10D 13/12* (2020.01)

(52) U.S. Cl.
CPC ..... *G10D 13/12* (2020.02)

(58) Field of Classification Search
CPC ..... G10D 13/12
See application file for complete search history.

(56) References Cited

U.S. PATENT DOCUMENTS 4,523,702 A * 6/1985 Viio ..... A45F 5/00 206/479
4,531,443 A * 7/1985 Gillis, Jr. ..... G10D 13/12 84/329
D319,836 S * 9/1991 Clouse ..... 84/329
5,117,724 A * 6/1992 Gardner ..... G10D 13/12 84/421
5,199,621 A * 4/1993 McLennan ..... A45F 5/00 224/673
5,370,288 A * 12/1994 Field ..... A45C 13/02 211/60.1
5,435,220 A * 7/1995 Pultz ..... G10D 13/12 84/329
5,967,391 A * 10/1999 Hunt ..... A01M 31/004 224/222

(Continued)

*Primary Examiner* — Robert W Horn
(74) *Attorney, Agent, or Firm* — Ansari Katiraei LLP; Arman Katiraei; Sadiq Ansari

(57) ABSTRACT

Provided is a wearable drumstick holding apparatus with an integrated practice pad that may wrap around and attach to a user's leg or thigh, and that may provide tear-away rapid retrieval of drumsticks. The apparatus may include an elastic base and connectors on either side of the base. The apparatus may include a pocket about a distal end of the base. The pocket imposes a force about a first segment of an object inserted into the pocket. The apparatus may include a tear-away retainer about a proximate end of the base. The tear-away retainer may be permanently attached to the base on a first side, and may attach and detach from the base about an opposite second side. The tear-away retainer retains the object about a different second segment of the object, and releases the object by detaching the second side in response to a pull force.

17 Claims, 6 Drawing Sheets

(56) References Cited

U.S. PATENT DOCUMENTS

| | | | | |
|---|---|---|---|---|
| 7,164,074 | B1 * | 1/2007 | Graham | G10D 13/12 84/421 |
| D570,096 | S * | 6/2008 | VanderPal | G10D 13/12 D3/204 |
| 7,601,903 | B1 * | 10/2009 | Monk | G10D 13/12 84/422.4 |
| 7,687,699 | B2 * | 3/2010 | Briggs | G10D 13/12 84/422.4 |
| D614,860 | S * | 5/2010 | Sikora | D3/204 |
| D715,851 | S * | 10/2014 | Chambers | D17/99 |
| 8,878,039 | B2 * | 11/2014 | Chambers | G01D 13/02 84/453 |
| D779,812 | S * | 2/2017 | Cohen | D3/204 |
| 9,564,113 | B2 * | 2/2017 | Bradfield | G10G 5/00 |
| 10,062,364 | B1 * | 8/2018 | Amaral | A45F 5/00 |
| 2015/0302837 | A1 * | 10/2015 | Massimo | G10G 5/00 206/314 |
| 2020/0118529 | A1 * | 4/2020 | Shahinian | G10D 13/12 |

* cited by examiner

WEARABLE DRUMSTICK HOLDER PROVIDING TEAR-AWAY RETRIEVAL AND INTEGRATED PRACTICE PAD

CLAIM OF BENEFIT TO RELATED APPLICATIONS

This application claims the benefit of U.S. provisional application 62/766,340, entitled "Drumstick holster with built in practice pad", filed Oct. 15, 2018. The contents of application 62/766,340 are hereby incorporated by reference.

BACKGROUND

Drummers may use two or more drumsticks when playing a set of songs. For instance, a drumstick may break during playing, may fall out of the drummer's hand, may be given away, etc.

To supply the drummer with replacement drumsticks, a drumstick bag or cylinder may be mounted to the drum set, and replacement drumsticks may be placed inside the bag or cylinder. Drummers may have difficulty locating and removing drumsticks from these bags and cylinders as the drummer may first have to locate the position of the bag or cylinder on the drum set before visually identifying an end segment of the drumstick that may extend out from the bag or cylinder. In the course of playing a song, these actions may cause the drummer to miss a beat, fall behind, and/or otherwise disrupt the song.

DETAILED DESCRIPTION OF PREFERRED EMBODIMENTS

The following detailed description refers to the accompanying drawings. The same reference numbers in different drawings may identify the same or similar elements.

Disclosed is a wearable drumstick holder that may wrap around and attach to the user's (e.g., drummer's) leg or thigh. The wearable drumstick holder may include an integrated practice pad, and may provide tear-away rapid retrieval of drumsticks.

The wearable drumstick holder retains one or more replacement drumsticks against the user's leg so that the user can quickly retrieve a replacement drumstick by feel. In particular, the user may retrieve a replacement drumstick without having to locate or identify the position of the drumstick.

To further facilitate the quick and easy retrieval of a replacement drumstick, the wearable drumstick holder retains each replacement drumstick about two small sections of the drumstick. Accordingly, large sections of the drumstick are exposed to the user. The user is therefore able to retrieve a replacement drumstick from the wearable drumstick holder by simply grabbing and pulling against any of the exposed sections of the drumstick rather than having to visually identify the location of a traditional replacement drumstick bag or cylinder mounted to the drum set before visually identifying a small exposed end of the drumstick that pokes out the top of the traditional replacement drumstick bag or cylinder. As a result, the wearable drumstick holder reduces the time and effort for retrieving a replacement drumstick, thereby allowing the user to continue play without missing a beat even when a replacement drumstick is needed when playing a song.

Figure 1:
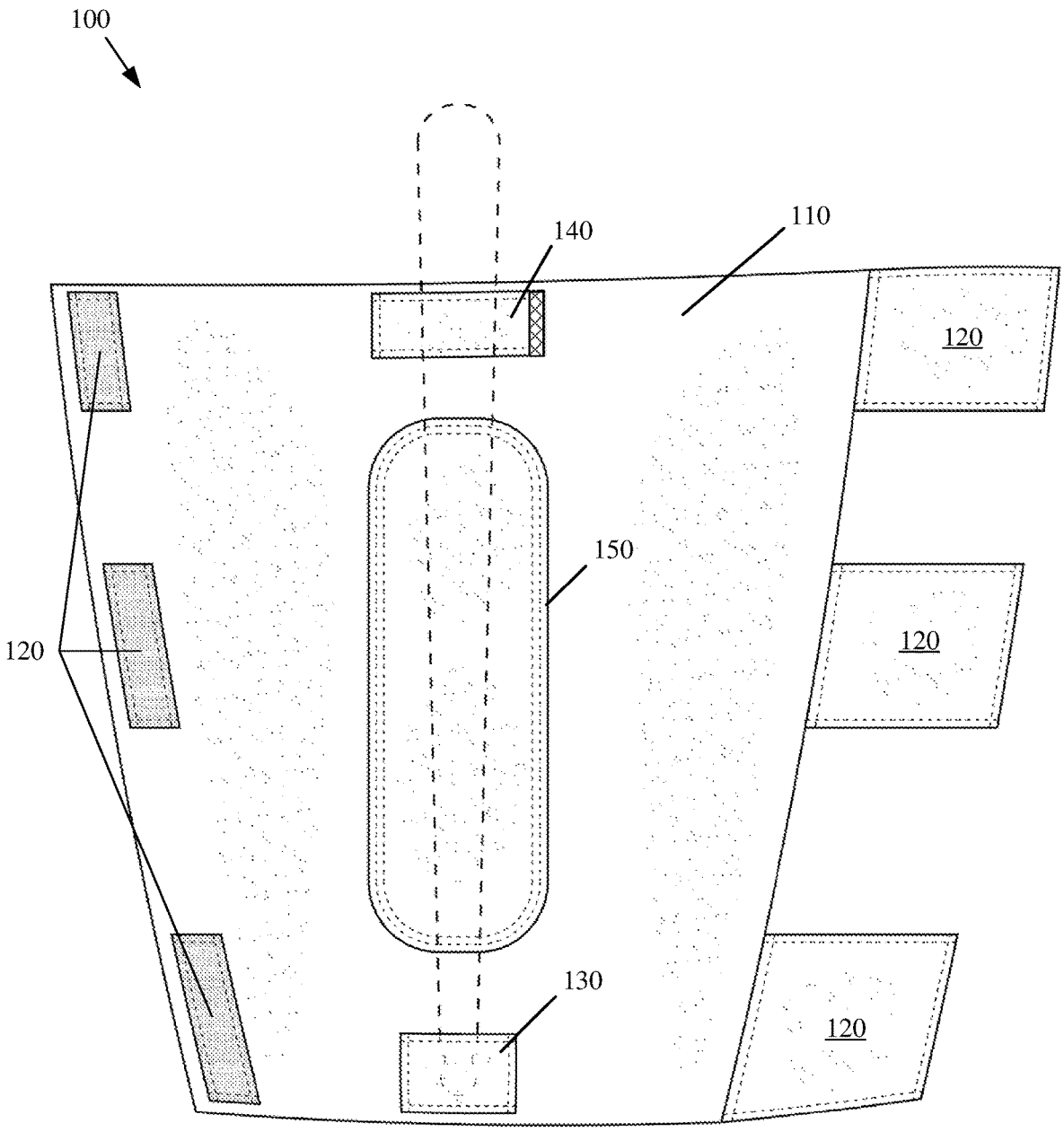
FIG. 1 presents a vertical orientation and top view of a wearable drumstick holder in accordance with some embodiments presented herein.
Figure 2:
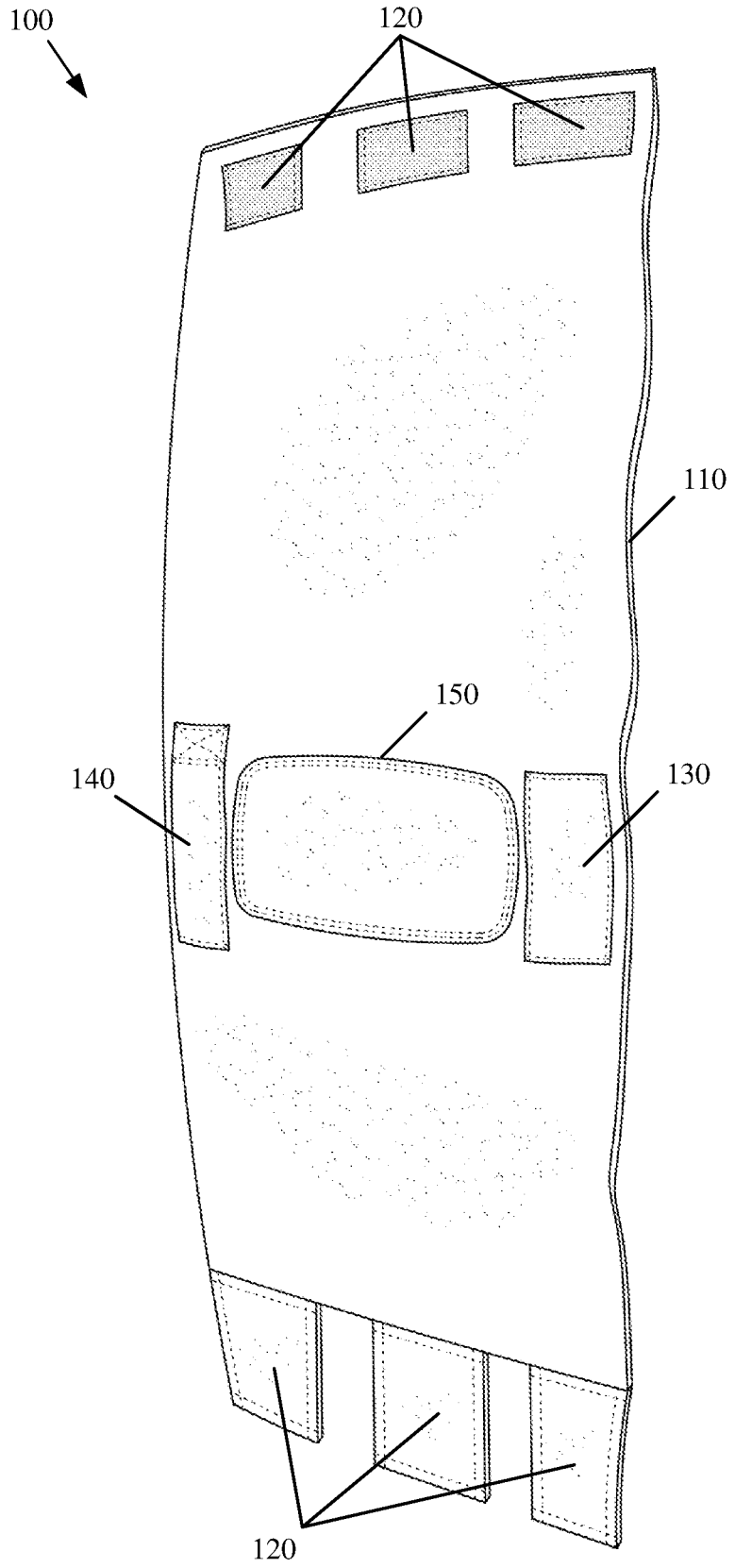
FIG. 2 presents a horizontal orientation and perspective view of the wearable drumstick holder in accordance with some embodiment presented herein.

FIG. 1 presents a vertical orientation and top view of wearable drumstick holder 100 in accordance with some embodiments presented herein. FIG. 2 presents a horizontal orientation and perspective view of wearable drumstick holder 100 in accordance with some embodiments presented herein.

Wearable drumstick holder 100 may include base 110, connectors 120, first retainer 130, second retainer 140, and practice pad 150. Different embodiments of wearable drumstick holder 100 may include more or less components, a different arrangement of components, and/or components of different sizes.

Base 110 may include a flexible and/or elastic material. Base 110 is made of a flexible and/or elastic material in order to wrap around different sized legs or thighs of different drummers, and retain a position about the leg or thigh by compressing around the leg or thigh via the integrated elasticity. In some embodiments, base 110 is made from neoprene, cotton, polyester, nylon, and/or another fabric, felt, or material with elasticity.

Base 110 may range between 1 millimeter ("mm") to 10 mm in thickness. Base 110 may have a length between 6 and 12 inches, and a width between 14 and 30 inches to fit users of different sizes. As shown in FIG. 1, the top and bottom ends of base 110 may have different widths to accommodate the changing thickness of a user's thigh from knee to hip. For instance, a distal end of wearable drumstick holder 100 may have a first width (e.g., 16 inches) for the thinner portion of the user's leg that is closest to the knee, and a proximate end of wearable drumstick holder 100 may have a second width (e.g., 26 inches) for the thicker portion of the user's let that is closest to the hips.

In some embodiments, base 110 may have a rectangular shape. As shown in FIG. 1, base 110 may have a tapered shape as a result of the different widths at either end of base 110. For instance, base 110 may be in the shape of an isosceles trapezoid. In some embodiments, base 110 may be rounded or have a curvature that conforms with the curvature of the average human thigh.

Each of connectors 120, first retainer 130, tear-away retainer 140, and practice pad 150 may be attached or connected to base 110. For instance, connectors 120, first retainer 130, tear-away retainer 140, and practice pad 150 may be sewn onto, adhered to (e.g., with an adhesive), extend from, and/or otherwise attached to base 110 with one or more fasteners.

Connectors 120 may be disposed on either side of wearable drumstick holder 100. Connectors 120 may include one or more complimentary pairs of attachable and detachable couplers, opening or closing fasteners, or male and female fasteners. In some embodiments, connectors 120 include a set of adjustable Velcro straps with hooks that are aligned with a set of Velcro loops on the other side of wearable drumstick holder 100. In some embodiments, connectors 120 may include a set of slide hooks, push buttons, zipper, buckle, string, snaps, and/or other fasteners for connecting either side of wearable drumstick holder 100.

Connectors 120 may be used to secure one side of wearable drumstick holder 100 to the other side by connecting connectors 120 on either side of wearable drumstick holder 100 together. Specifically, a user attaches wearable drumstick holder 100 to his/her leg or thigh by stretching and wrapping base 110 around the leg or thigh, and by connecting connectors 120 on either side of base 110 together to retain the position of wearable drumstick holder 100 against the leg or thigh. Once secured, the stretched elastic material of base 110 retains a position of wearable drumstick holder 100 against the leg or thigh, and prevents holder 100 from moving up or down the leg or thigh or from rotating around the leg or thigh.

In some embodiments, there may be one or more connectors 120 on either side of base 110. For instance, instead of the three complimentary connectors 120 shown on either side of wearable drumstick holder 100 in FIG. 1, a single connector 120 may run the full length across either side of base 110.

First retainer 130 may be located about either the distal end or the proximate end of base 100. In preferred embodiments, first retainer 130 may be located at the distal end that is closest to the user's knee when wearable drumstick holder 100 is attached to the user's leg.

First retainer 130 may provide an elastic pocket into which the tip of a replacement drumstick can be inserted and held in place via an elastic force imposed around the drumstick tip by first retainer 130. In some embodiments, first retainer 130 may include a square or rectangular section of neoprene that is sewn onto base 110. In some such embodiments, first retainer 130 may be attached about three sides to base 110. The side of first retainer 130 that is directed towards a center of base 110 may be exposed (e.g., not sewn or attached to base 110) so that the replacement drumstick tip can be inserted into first retainer 130 via the exposed side but cannot move through or past first retainer 130.

In some embodiments, first retainer 130 may be a strap that is attached about the left and right sides to base 110. In some such embodiments, the top and bottom sides of first retainer 130 may be exposed or not attached to base 110. In this configuration, the replacement drumstick can be inserted into first retainer 130 with the replacement drumstick tip sliding through and past first retainer 130. Nevertheless, first retainer 130 may retain a position of the drumstick via an elastic force that pushes the drumstick portion that is under first retainer 130 against base 110. The width of first retainer 130 can further aid in retaining the drumstick as the width of the drumstick may increase from its tip. Accordingly, the width of first retainer 130 may be slightly larger than the width of the drumstick tip in order to impose a retention force when the tip of drumstick is slid through first retainer 130. For instance, the width of first retainer 130 may range from 1 to 3 inches. First retainer 130 may have a length ranging from 0.5 inches to 2 inches. The length is at least equal to the length of the drumstick tip.

Second retainer 140 may function in conjunction with first retainer 130 to retain the replacement drumstick position on wearable drumstick holder 100. Second retainer 140 may be disposed at an opposite end of base 110 than first retainer 130. In preferred embodiments, second retainer 140 may be positioned about the proximate end that is closest to the user's hip when wearable drumstick holder 100 is attached to the user's leg. Accordingly, a first end or part of the replacement drumstick may be placed under and held in place by first retainer 130 at one end of wearable drumstick holder 100, and a different second end or part of the replacement drumstick may be placed under and held in place by second retainer 140 at another end of wearable drumstick holder 100.

The dimensions of second retainer 140 may the same or similar to the dimensions of first retainer 130. Accordingly, the width of second retainer 140 may range from 1 to 3 inches, and second retainer 140 may have a length ranging from 0.5 inches to 2 inches.

In some embodiments, second retainer 140 may be a strap that is sewn or attached to base 110 about the left and right sides of second retainer 140. In some such embodiments, the replacement drum stick may be removed by pulling the replacement drumstick away from wearable drumstick holder 100. For instance, when second retainer 140 is located at the distal end (e.g., near the user's knee), the user may grab the exposed end of the replacement drumstick jutting out towards his or her knee, and may pull the replacement drumstick out in front of the user's body. Similarly, when second retainer 140 is located at the proximate end (e.g., near the user's hip), the user may grab the exposed end of the replacement drumstick jutting out towards his or her hip, and may pull the replacement drumstick out behind the user's body.

In some embodiments, second retainer 140 may be sewn or attached on one side to base 110, and may be connected about an opposite side to base 110 using a tear-away connector, such as Velcro or a push button. Second retainer 140 may be made of the same elastic material as first retainer 130 and/or base 110, or may be made of a material that has no elasticity to reduce the force needed to tear-away one end of second retainer 140 from base 110.

The tear-away function of second retainer 140 simplifies the retrieval and/or removal of the replacement drumstick from wearable drumstick holder 100. For instance, rather than grab the replacement drumstick at an exposed end and pull the replacement drumstick out in front or behind the user, the tear-away function of second retainer 140 allows the user to grab any exposed section of the replacement drumstick (e.g., exposed middle section or end section), and to simply pull away the replacement drumstick away from wearable drumstick holder 100. In particular, when the user is ready to retrieve the replacement drumstick from wearable drumstick holder 100, the user may reach towards his or her thigh, may grab any exposed section of the replacement drumstick between first retainer 130 and second retainer 140 or any exposed section of the replacement drumstick that extends past second retainer 140 and/or over an end of base 100, and may pull the replacement drumstick away from his or her thigh. In response to pulling the replacement drumstick, second retainer 140 will tear-away and open from one side, thereby allowing the user to remove the replacement drumstick perpendicularly or vertically away from wearable drumstick holder 100. In particular, second retainer 140 frees the replacement drumstick at one end such that the other end of the replacement drumstick simply slides out from first retainer 130. This perpendicular retrieval may be faster than the parallel retrieval of sliding the entire length of the drumstick through first retainer 130 and second retainer 140.

Figure 3:
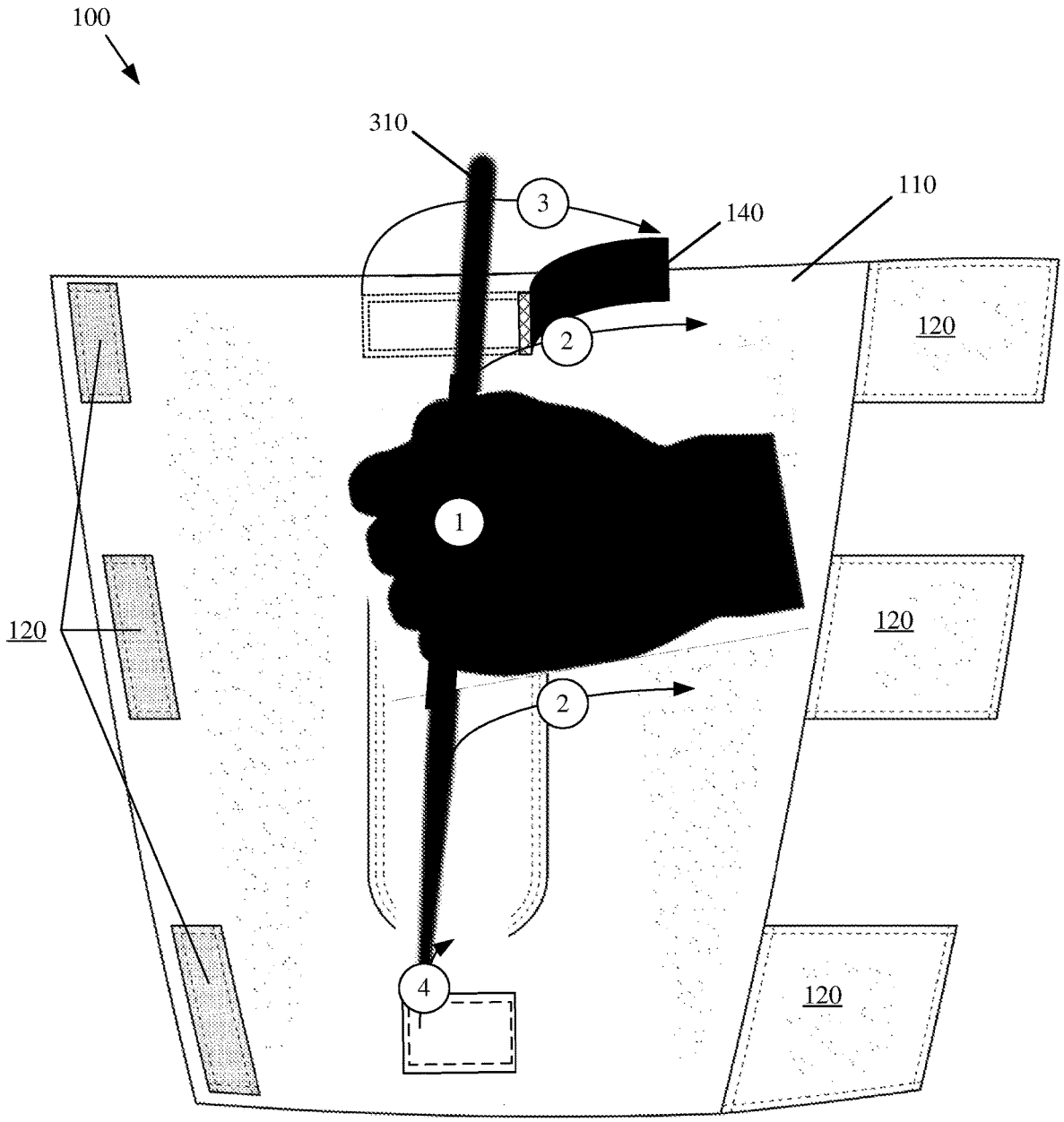
FIG. 3 illustrates an example of removing a drumstick from the wearable drumstick holder using the tear-away function in accordance with some embodiments presented herein.

FIG. 3 illustrates an example of removing a drumstick from wearable drumstick holder 100 using the tear-away function of second retainer 140 in accordance with some embodiments presented herein. As shown in FIG. 3, a user grabs (at 1) an exposed middle section of drumstick 310, and pulls (at 2) drumstick 310 vertically off and away from wearable drumstick holder 100. In response to the user pulling on drumstick 310, second retainer opens (at 3) allowing drumstick 310 to be lifted away from wearable drumstick holder 100, which in turn causes the tip of drumstick 310 to slide out from first retainer 130.

In some embodiments, wearable drumstick holder 100 may include practice pad 150. Practice pad 150 may provide a reinforced pad or section of material on which a drummer may practice without producing noise and/or with minimal impact to the user's leg. For instance, some drummers like to warm-up or practice without disturbing others, and may hit the drumstick directly against their legs to warm-up or practice. Practice pad 150 absorbs the impact and provides a layer of protection that allows the drummer to practice at full speed and strike as hard as desired without hurting his or her leg. When wearable drumstick holder 100 is secured to one's leg, practice pad 150 is positioned over the user's leg.

In some embodiments, practice pad 150 may be an oval or rectangular pad that is attached over a middle of base 110. Practice pad 150 may include plastic, foam, and/or other material in between base 110 and a cover of practice pad 150, and the cover may be sewn or otherwise attached to base 110. In some embodiments, practice pad 150 may add 2 mm to 10 mm of thickness over base 110. In some embodiments, practice pad 150 may have a width between 2-5 inches, and practice pad 150 may run almost the entire length of base 110 (e.g., 6 to 12 inches).

Figure 4:
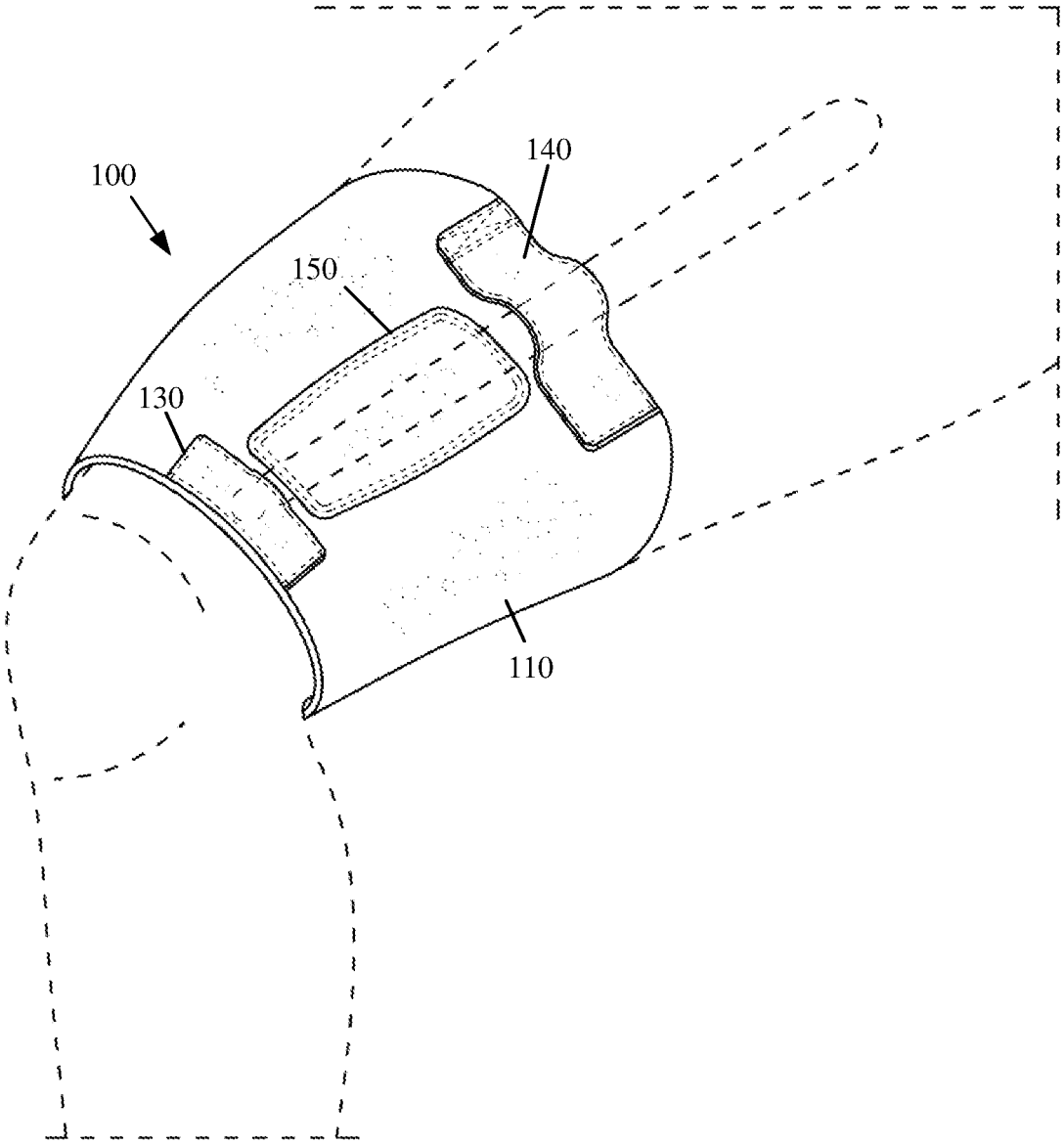
FIG. 4 illustrates usage of the wearable drumstick holder in accordance with some embodiments presented herein.

FIG. 4 illustrates usage of wearable drumstick holder 100 in accordance with some embodiments presented herein. As shown in FIG. 4, wearable drumstick holder 100 is wrapped around the user's leg, and connectors 120 (not visible) on either side of holder 100 are attached under the user's leg to secure wearable drumstick holder 100 to the user's leg.

As further shown in FIG. 4, a replacement drumstick is held in place over practice pad 150 by first retainer 130 and second retainer 140. In particular, the replacement drumstick is held over the user's leg and/or about an outside of the user's leg.

As noted above, different embodiments of wearable drumstick holder 100 may include different structures or components. For instance, in some embodiments, both first retainer 130 and second retainer 140 may provide tear-away functionality, and may have one side (e.g., a left or right side) that is permanently attached to base 110 and an opposite side with Velcro, a push button, or another mechanism that attaches and detaches from base 110 in response to a force pulling or pushing the retainer away from base 110. Additionally, different embodiments wearable drumstick holder 100 may provide a different arrangement of structures or components.

Figure 5:
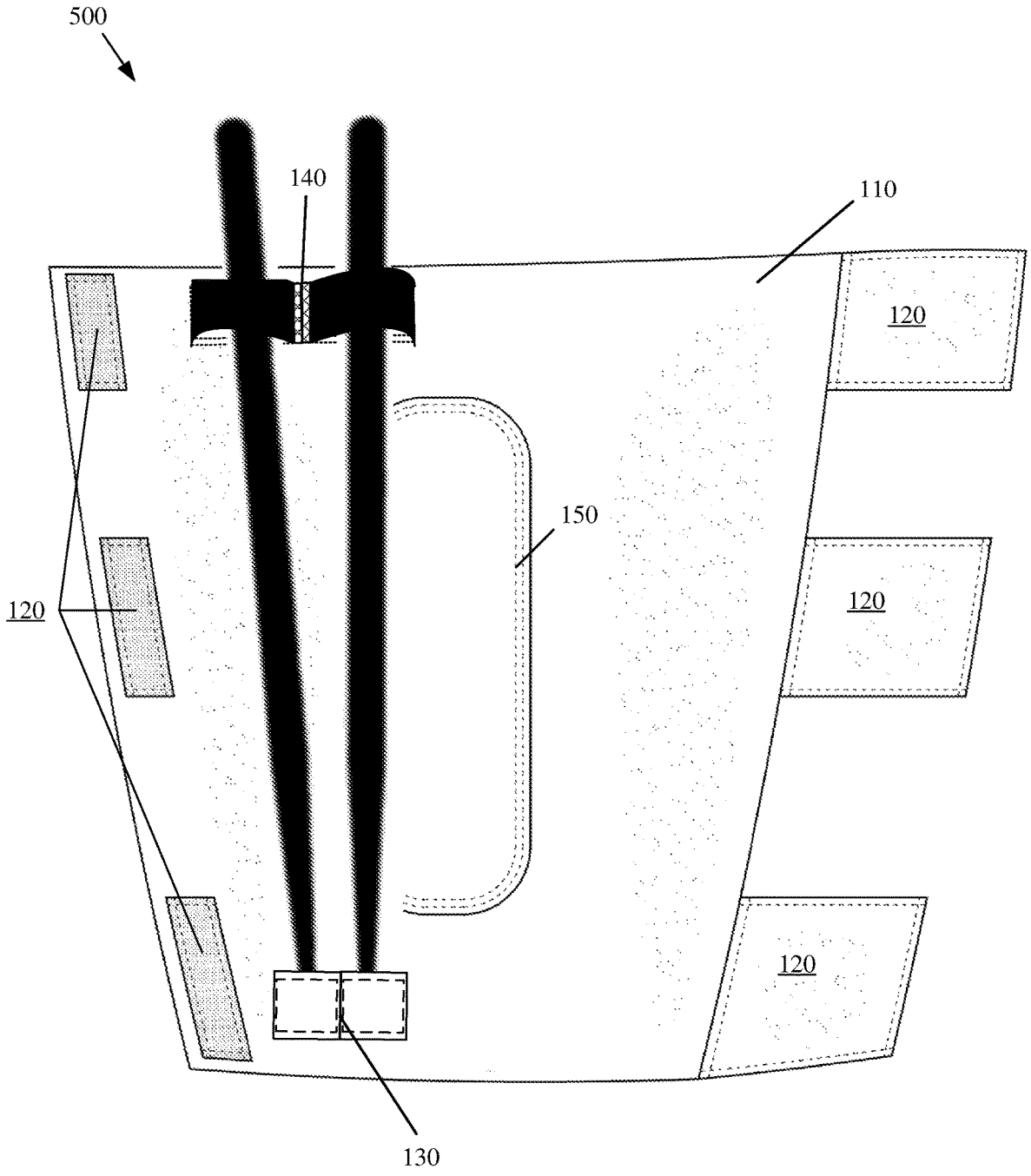
FIG. 5 illustrates a first example of a modified wearable drumstick holder that is adapted to retain two or more drumsticks in accordance with some embodiments presented herein.

FIG. 5 illustrates a first example of modified wearable drumstick holder 500 that is adapted to retain two or more drumsticks in accordance with some embodiments presented herein. Modified wearable drumstick holder 500 adapts first retainer 130 and second retainer 140 to separately hold two different drumsticks in accordance with some embodiments presented here. As shown in FIG. 5, the positions of first retainer 130 and second retainer 140 have also been shifted to the left of practice pad 150.

Figure 6:
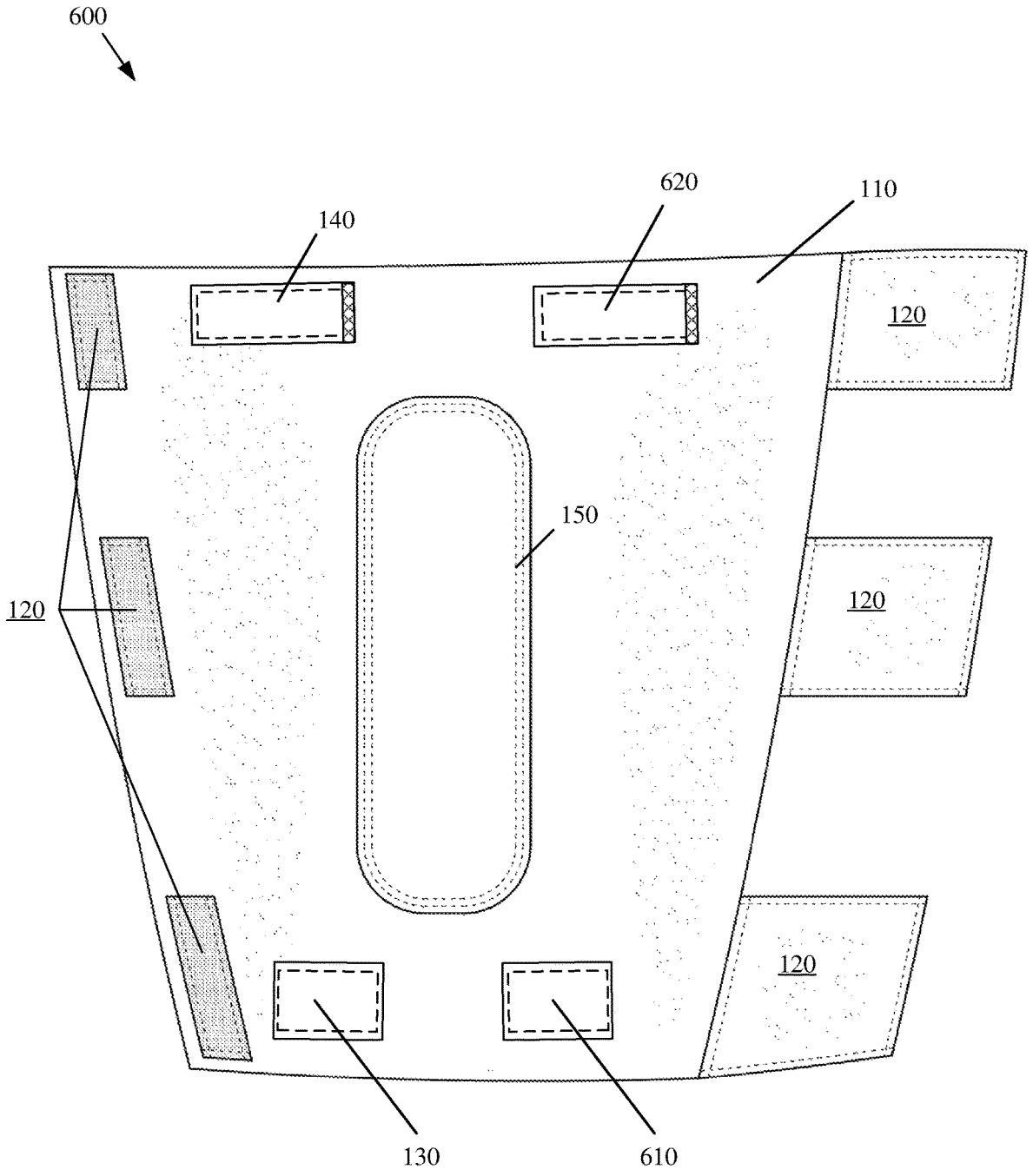
FIG. 6 illustrates a second example of a modified wearable drumstick holder that is adapted to retain two or more drumsticks in accordance with some embodiments presented herein.

FIG. 6 illustrates a second example of modified wearable drumstick holder 600 that is adapted to retain two or more drumsticks in accordance with some embodiments presented herein. As shown in FIG. 6, modified wearable drumstick holder 600 may position first retainer 130 and second retainer 140 about one side of practice pad 150, and may position third retainer 610 and fourth retainer 620 about the other side of practice pad 150.

First retainer 130 and second retainer 140 may be used to hold a first replacement drumstick while third retainer 610 and fourth retainer 620 may be used to hold a second replacement drumstick. The distance between retainers 130 and 140, that are used to hold the first replacement drumstick, and retainers 610 and 620, that are used to hold the second replacement drumstick, allow the user to individually retrieve the drumsticks, and/or to better differentiate between which drumstick is being retrieved without having to visually look at the drumstick being retrieved.

Third retainer 610, similar to first retainer 130, may include a pocket into which the second replacement drumstick tip or end may be inserted. Fourth retainer 620, similar to second retainer 140, may include a tear-away strap with one end that opens and lifts away from base 110 when force is exerted on second retainer 140 or the second replacement drumstick held in place by fourth retainer 620.

The foregoing description of implementations provides illustration and description, but is not intended to be exhaustive or to limit the possible implementations to the precise form disclosed. Modifications and variations are possible in light of the above disclosure or may be acquired from practice of the implementations. Moreover, even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

Some implementations described herein may be described in conjunction with thresholds. The term "greater than" (or similar terms), as used herein to describe a relationship of a value to a threshold, may be used interchangeably with the term "greater than or equal to" (or similar terms). Similarly, the term "less than" (or similar terms), as used herein to describe a relationship of a value to a threshold, may be used interchangeably with the term "less than equal to" (or similar terms). As used herein, "exceeding" a threshold (or similar terms) may be used interchangeably with "being greater than a threshold," "being greater than or equal to a threshold," "being less than a threshold," "being less than or equal a threshold," or other similar terms, depending on the context in which the threshold is used.

No element, act, or instruction used in the present application should be construed as critical or essential unless explicitly described as such. An instance of the use of the term "and," as used herein, does not necessarily preclude the interpretation that the phrase "and/or" was intended in that instance. Similarly, an instance of the use of the term "or," as used herein, does not necessarily preclude the interpretation that the phrase "and/or" was intended in that instance. Also, as used herein, the article "a" is intended to include one or more items, and may be used interchangeably with the phrase "one or more." Where only one item is intended, the terms "one," "single," "only," or similar language is used. Further, the phrase "based on" is intended to mean "based, at least in part, on" unless explicitly stated otherwise.

What is claimed is:

1. An apparatus comprising:

an elastic base;

a first set of connectors on a right side of the elastic base;

a second set of connectors on a left side of the elastic base that are aligned with the first set of connectors and that couple with the first set of connectors;

a pocket attached to the elastic base about a distal end of the elastic base, wherein the pocket imposes a force about a first segment of an object inserted into the pocket; and a tear-away retainer attached to the elastic base about a proximate end of the elastic base, wherein the tear-away retainer is permanently attached to the elastic base on a first side, and attaches and detaches from the elastic base about an opposite second side, and wherein the tear-away retainer retains the object about a different second segment of the object when the object is placed under the tear-away retainer, and releases the object by detaching the second side in response to a pull force exerted on the object.

2. The apparatus of claim 1 further comprising an elevated pad about a center of the elastic base, the elevated pad providing a padded surface against which to strike the object.

3. The apparatus of claim 2, wherein the pocket is aligned below the elevated pad, and wherein the tear-away retainer is aligned over the elevated pad and parallel with the pocket.

4. The apparatus of claim 1, wherein the elastic base stretches around a user thigh and is held in place against the user thigh in response to connecting the first set of connectors to the second set of connectors.

5. The apparatus of claim 1, wherein the elastic base has a length between 6 inches and 12 inches, and wherein the elastic base has a width between 14 inches and 30 inches.

6. The apparatus of claim 1, wherein the pocket and tear-away retainer each have a width between 1 inch and 3 inches.

7. The apparatus of claim 1, wherein the object is a drumstick, wherein the first segment of the drumstick is held against the apparatus by the pocket, and wherein the second segment of the drumstick is held against the apparatus by the tear-away retainer.

8. The apparatus of claim 1, wherein the second side of the tear-away retainer comprises one of Velcro or a push button.

9. The apparatus of claim 1, wherein the elastic base has a tapered shape with a width at a top end of the elastic base being greater than a width at a bottom end of the elastic base.

10. The apparatus of claim 1, wherein the first set of connectors comprises a set of Velcro straps with hooks, and wherein the second set of connectors comprises a set of Velcro loops.

11. The apparatus of claim 1, wherein the elastic base is made of neoprene.

12. A wearable drumstick holding apparatus, the apparatus comprising:

a stretchable base with a length between a top side and a bottom side that is between 6 inches and 12 inches, and with a width between 14 inches and 30 inches;

a set of connectors about a right side and a left side of the stretchable base, the set of connectors securing the stretchable base around a user thigh in response to wrapping the stretchable base around the user thigh and connecting the set of connectors about the right side to the set of connectors about the left side;

a first retainer with a width between 1 inch and 3 inches that is disposed over the stretchable base about the bottom side and that is attached to the stretchable base on three sides with an exposed fourth side; and a second retainer with a width between 1 inch and 3 inches disposed over the stretchable base about the top side, wherein the first retainer and the second retainer retain a drumstick parallel to the user thigh in response to securing the stretchable base around the user thigh, inserting a first segment of the drumstick underneath the first retainer, and inserting a second segment of the drumstick underneath the second retainer.

13. The apparatus of claim 12, wherein the first retainer and the second retainer expose a middle segment of the drumstick that is between the first retainer and the second retainer, and an end segment of the drumstick that extends beyond the second retainer.

14. The apparatus of claim 12, wherein at least one of the first retainer and the second retainer may comprise one side that attaches to the stretchable base, and that detaches from the stretchable base in response to force moving away from the stretchable base.

15. The apparatus of claim 12 further comprising padding disposed between the first retainer and the second retainer.

16. The apparatus of claim 15, wherein the padding creates an elevated surface that absorbs and silences strikes of the drumstick.

17. A wearable drumstick holding apparatus, the apparatus comprising:

a stretchable base with a length between a top side and a bottom side that is between 6 inches and 12 inches, and with a width between 14 inches and 30 inches;

a set of connectors about a right side and a left side of the stretchable base, the set of connectors securing the right side to the left side in response to coupling the right side of the stretchable base to the left side of the stretchable base;

a first retainer with a width between 1 inch and 3 inches disposed over the stretchable base about the bottom side; and a second retainer with a width between 1 inch and 3 inches disposed over the stretchable base about the top side, wherein at least one of the first retainer and the second retainer comprises one side that attaches to the stretchable base, and that detaches from the stretchable base in response to force moving away from the stretchable base.

* * * * *